US007131352B1

(12) United States Patent
Saunders

(10) Patent No.: US 7,131,352 B1
(45) Date of Patent: Nov. 7, 2006

(54) LIGHT BULB CATCHER FOR USE WITH A CHANGING DEVICE

(76) Inventor: LaMoine Saunders, 27 E. Oakwood Hills Dr., Chandler, AZ (US) 85248

( * ) Notice: Subject to any disclaimer, the term of this patent is extended or adjusted under 35 U.S.C. 154(b) by 188 days.

(21) Appl. No.: 10/888,900

(22) Filed: Jul. 8, 2004

(51) Int. Cl.
*H01K 3/32* (2006.01)

(52) U.S. Cl. ..... 81/53.11; 81/64; 294/19.1

(58) Field of Classification Search ..... 81/53.11, 81/64, 53.1, 53.12; 56/329–340; 294/19.1, 294/19.3, 22, 23
See application file for complete search history.

(56) References Cited

U.S. PATENT DOCUMENTS 2,157,563 A 5/1939 Pethick
2,223,344 A * 12/1940 Grinnell ..... 81/53.11
2,243,106 A 5/1941 Limbert
2,556,701 A 6/1951 Mozena
5,218,889 A 6/1993 Brockberg
5,371,658 A * 12/1994 Christie ..... 294/106
5,829,324 A * 11/1998 Secor ..... 81/53.11
6,553,872 B1 4/2003 Tes et al.
6,739,219 B1 * 5/2004 Cuevas ..... 81/53.1

* cited by examiner

*Primary Examiner*—Hadi Shakeri
(74) *Attorney, Agent, or Firm*—Schmeiser, Olsen & Watts

(57) ABSTRACT

A light bulb catch is disclosed that comprises a catcher and an attachment mechanism. The catcher may be rotatably or slideably connected to a pole through a rotatable connection and connector. A distal end of the catcher may also be biased away from a proximal end of the catcher or the catcher may be deformable, in order to increase maneuverability and allow the catcher to be moveable between an extended and retracted position. A work product end of the pole, which is contained in the catcher and connects to the attachment mechanism, may telescope and may also be biased towards a forward position, moveable to a rearward position, allowing the user to apply pressure to the light bulb changing device without damaging the bulb. The catch may have many purposes besides simply changing light bulbs as will be realized by those in the art.

15 Claims, 5 Drawing Sheets

LIGHT BULB CATCHER FOR USE WITH A CHANGING DEVICE

BACKGROUND OF THE INVENTION

1. Technical Field

This invention relates to a light bulb catching device for use in changing light bulbs in elevated or hard to reach locations such as high ceilings where direct handling of the light bulbs cannot readily be done by the light bulb changer.

2. Background Art

There are many extension devices for use in changing light bulbs that are hard to reach. Most of these devices focus on methods of removing a light bulb from a light socket that is elevated, specifically on attachment mechanisms that allow the user to unscrew the light bulb from a distance. These include mechanisms such as suction cups or capture attachments.

The problem with most prior devices has been the danger of the light bulb disengaging from the attachment mechanisms resulting in the light bulb falling. Due to the height of the light bulb, when it falls and shatters the glass shards may cause injury to the bulb changer as well as any other individual in the immediate area. As the height of the light bulb to be changed increases, small movements by the installer will induce a greater movement at the end of the pole affixed to the light bulb. The unsteady pole movement often results in the bulb striking against the socket, ceiling, fixture or a recessed wall and dislodging the light bulb or breaking the vacuum seal, resulting in the bulb falling. Additionally, dust and grime build-up on the surface of a light bulb creates an imperfect suction coupling, leading to a premature detachment of the light bulb while it is being held by the suction attachment. Furthermore, when lowering the light bulb it is generally necessary to tilt the pole, causing a loosely attached light bulb to fall. The falling light bulb creates a hazardous and dangerous projectile. In addition, trying to replace a burned out light bulb can become a costly venture as new light bulbs fall and break during the installation process.

The Tse et al. U.S. Pat. No. 6,553,872, as shown in FIG. 1, attempts to overcome these issues by creating an umbrella like structure 13 that expands underneath the light bulb 16 in order to catch the bulb 16 in case it falls. The umbrella 13 is rigid and cumbersome, creating many problems of its own. Light bulbs 16 in hard to reach places can be even harder to reach due to the fact that the umbrella 13 is so wide that it will not fit into small enclosed areas which might contain a light bulb 16. The umbrella 13 can also cause problems when the user 11 attempts to rotate the pole 12 in order to loosen the light bulb 16. As the pole 12 is rotated, the umbrella 13 is rotated causing scratches on the ceiling, in the case of recessed lighting, or on surrounding walls. Also, if the light bulb does fall and is caught by the Tse umbrella structure, the user must still try to lower the pole without having the bulb fall out of the catch. At a minimum, the light bulb catch of Tse encumbers the light bulb 16 replacing process.

Accordingly, what is needed is a catch for use when installing and removing light bulbs that overcomes the drawbacks of conventional catch devices.

DISCLOSURE OF THE INVENTION

The present invention may be readily adapted to a variety of light bulb changing devices and methods and systems for light bulb changing. Embodiments of the present invention may provide, among other benefits: a biased, slidably connected or deformable catcher that surrounds the sides of a light bulb attachment mechanism and also allows easier manipulation of the light bulb than the prior light bulb catches. The present invention also may provide a rotatably connected catcher which allows a pole connected to the attachment mechanism and the attachment mechanism to rotate with the catcher remaining stationary in order to prevent the catcher from damaging the ceiling or getting caught on another structure when the light bulb is being removed or installed. An embodiment of the present invention may also provide a telescoping pole that is biased in order to allow the user to apply pressure to the light bulb without breaking it.

In particular embodiments, the present invention provides a catch that may comprise a pole, a catcher connected by a connector to a work product end of the pole, and an attachment mechanism connected to a work product end of the pole.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings, where like designations denote like elements, and.

DESCRIPTION OF THE INVENTION

As discussed above, embodiments of the present invention relate to a catch. Generally, a catch configured to catch a falling light bulb according to an embodiment of the present invention may include a pole, a proximal end of a catcher connected to a work product end of the pole, and an attachment mechanism connected to the work product end of the pole. The sides of the attachment mechanism may be surrounded by the catcher.

Figure 1:
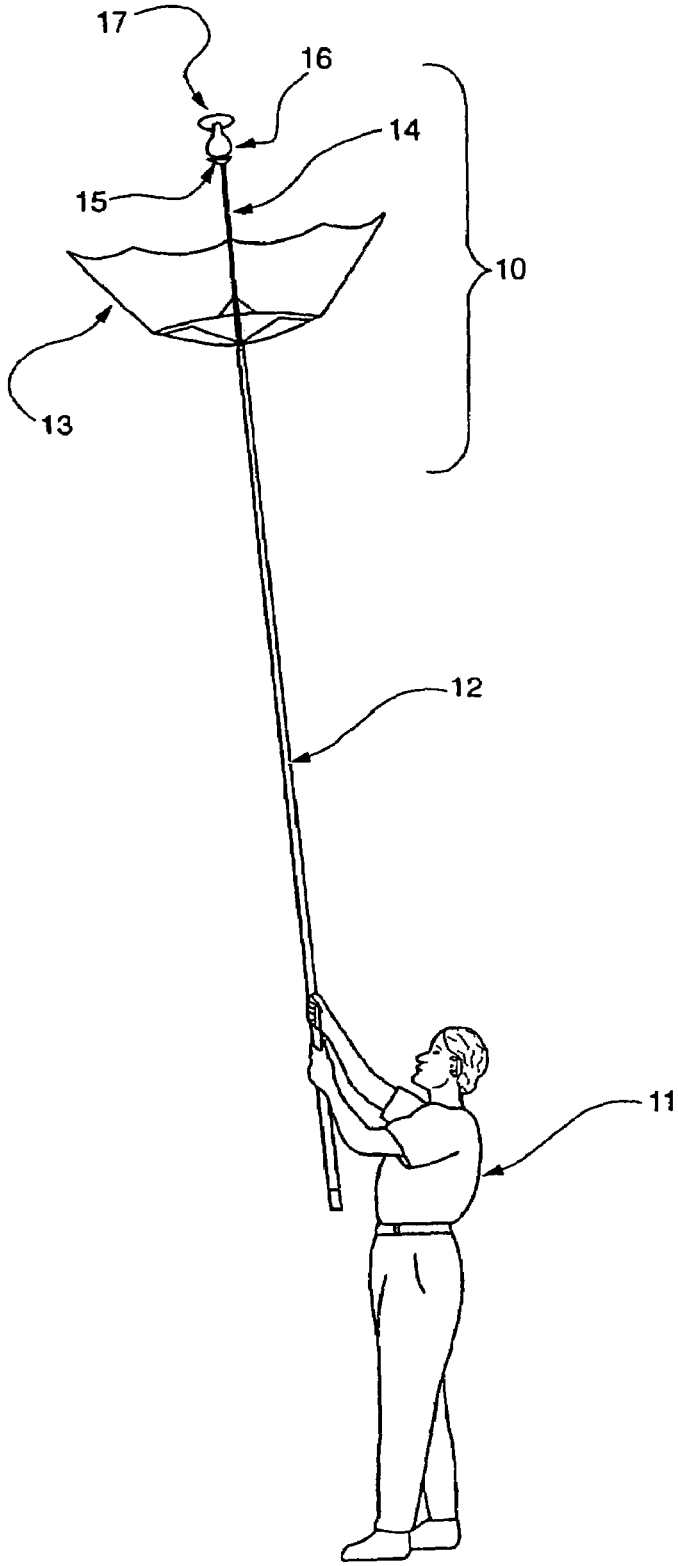
FIG. 1 (Prior Art)
FIG. 1 is a side view of a prior art light bulb changing device in use.

FIG. 1 shows a prior art light bulb changer wherein a user 11 uses a pole 12 which has a bulb securing attachment 15 attached to distal pole end 14. Attachment 15 engages a bulb 16 in a socket 17. Placed around the pole 12 is an umbrella like catch 13. The catch 13 is opened prior to lifting the pole 12 into position. It should be appreciated that as the pole 12 is raised or lowered into position, should the bulb 16 disengage from the attachment 15, it could easily either miss the catch completely or roll out of the catch. Even if the bulb lands in the catch when the pole is in a substantially upright position, the user still faces the challenge of lowering the device without having the bulb roll out of the catch.

Figure 2:
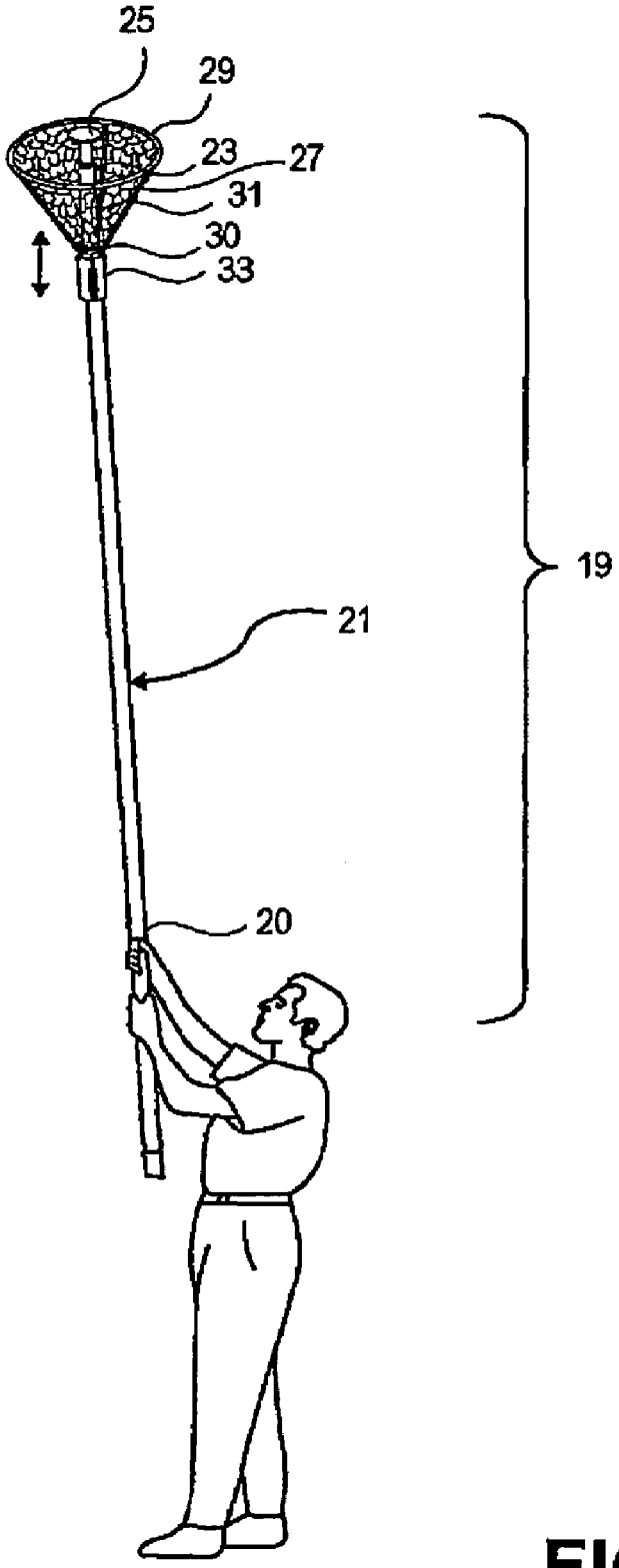
FIG. 2 is a side view of a catch on a light bulb changing device in use according to an embodiment of the present invention.

FIG. 2 illustrates a light bulb changer 19 incorporating the subject invention. The light bulb changer 19 of the current invention is used by manipulating a pole 21 with a catch attached, consisting of an attachment mechanism 25 and a catcher 31. The changer 19 is placed so that the attachment mechanism 25 is directly underneath the light bulb. The pole 21 is then rotated by the user. This motion unscrews the light bulb from the socket. The pole 21 is lowered with the light bulb attached to the attachment mechanism 25. If the light bulb bumps against something, it might come lose from the attachment mechanism 25. The bulb would then land in the catcher 31. Otherwise, a falling light bulb that hits the ground and shatters can be quite dangerous.

In order to replace a light bulb, the bulb is attached to the attachment mechanism 25. The pole 21 with the attachment mechanism 25 on the work product end 23 is then lifted upwards toward the light socket. If the light bulb is bumped during this process, the bulb will simply fall into the catcher 31, preventing the bulb from breaking. Once the bulb is placed in the socket, the pole 21 is turned in order to screw the bulb into the socket. The distal end 29 of the catcher 31 extends beyond the attachment mechanism 25 surrounding it except for the opening of the distal end 29 of the catcher 31, in order to assure that the light bulb will not fall free of the catcher 31 and injure a bystander. In order to allow the catcher 31 to surround the attachment mechanism 25 and still provide a useable catch, the catch, or distal end 29 of the catcher 31, is moveable between an extended position, where the attachment mechanism 25 is located between the proximal 30 and distal 29 ends of the catcher 31, and a retracted position where the attachment mechanism 25 is moved toward the distal end 29 of the catcher 31. This may be accomplished by biasing the distal end 29 of the catcher 31 which allows the user much more maneuverability when trying to remove or replace a light bulb. In other words, there is at least one spring or other device that is pushing the distal end 29 of the catcher 31 upwards towards the light socket. The spring bias allows the catcher 31 to be pushed up against the ceiling, and then the catcher 31 compresses slightly allowing the user to reach farther into the socket, while still having the catcher 31 firmly in place around the socket. The catcher 31 may also be moveable between an extended position and a retracted position by utilizing a deformable catcher 31. When the catcher 31 is forced up against the ceiling, the catcher 31 deforms or compresses allowing the user greater freedom to move the pole 21 while replacing the light bulb. The catcher 31 may even be slideably connected to the pole 21. This allows the catcher 31 to slide from an extended position to a retracted position by simply sliding up and down the pole 21. The catcher 31 may also be rotatably attached to the pole 21. This allows the pole 21 to freely rotate within the catcher 31. This means that when the user is rotating the pole 21 in order to replace the light bulb, the user does not also have to awkwardly rotate the catcher 31.

The work product end 23 of the pole 21 may telescope and within the telescoping joint may have a spring bias. This spring pushes the work product end 23 of the pole 21 which is connected to the attachment mechanism 25, towards the light socket, a forward position, and allows the user to put force on the light bulb changing device without breaking the light bulb, because there is give in the pole 21 as it is retracted to a rearward position. Where the attachment mechanism 25 is attachable to a standard pole it is possible to have the spring biased telescoping feature as a separate attachment or as part of the attachment mechanism 25. In this latter case the telescoping extension would likely have one end internally threaded in order to attach to the pole 21, with the other end of the extension being secured to the attachment mechanism 25.

The pole 21 provides the extension needed for the user to be able to reach a light bulb on the ceiling or in a hard to reach position. In essence, the pole 21 along with the other parts of the invention allow a user to change a light bulb from the ground that would usually require the person changing the light bulb to stand on a ladder in order to reach the bulb. The pole 21 is normally a long cylindrical tube that extends for the desired length. The pole 21 has a work product end 23 and a user end 20. The pole 21 is normally cylindrical, it may, however, have any cross-section desired, such as a square cross-section, triangular cross-section, oval cross-section and the like. The pole 21 may also be any length desired. Longer poles 21 are very useful for reaching light bulbs in buildings with vaulted ceilings or with very high ceilings or even outdoor areas with light bulbs. Shorter poles 21 may be useful for light bulbs in very hard to reach areas or for users with limited mobility. It may also be possible to interchange poles 21 in the device or to have a telescoping pole 21. A telescoping pole 21 would allow the user to choose the length of pole 21 most suitable for the task at hand. The pole 21 may then be fixed by some means at that length. A telescoping pole 21 makes the light bulb changing device 19 quite versatile. The pole 21 may be formed from any material that provides the strength required to unscrew the light bulb and to support the light bulb and any other weight that is attached to the end of the pole 21. The pole 21 may be formed from metal such as aluminum, steel, copper, zinc, metal alloys and the like. The pole 21 may also be formed from wood, provided the wood has enough strength to withstand any flex that may occur when the pole 21 is being manipulated from the user end 20 with weight on the work product end 23. The pole 21 may also be formed from plastics, or even from composite materials such as carbon fibers and the like.

Figure 3:
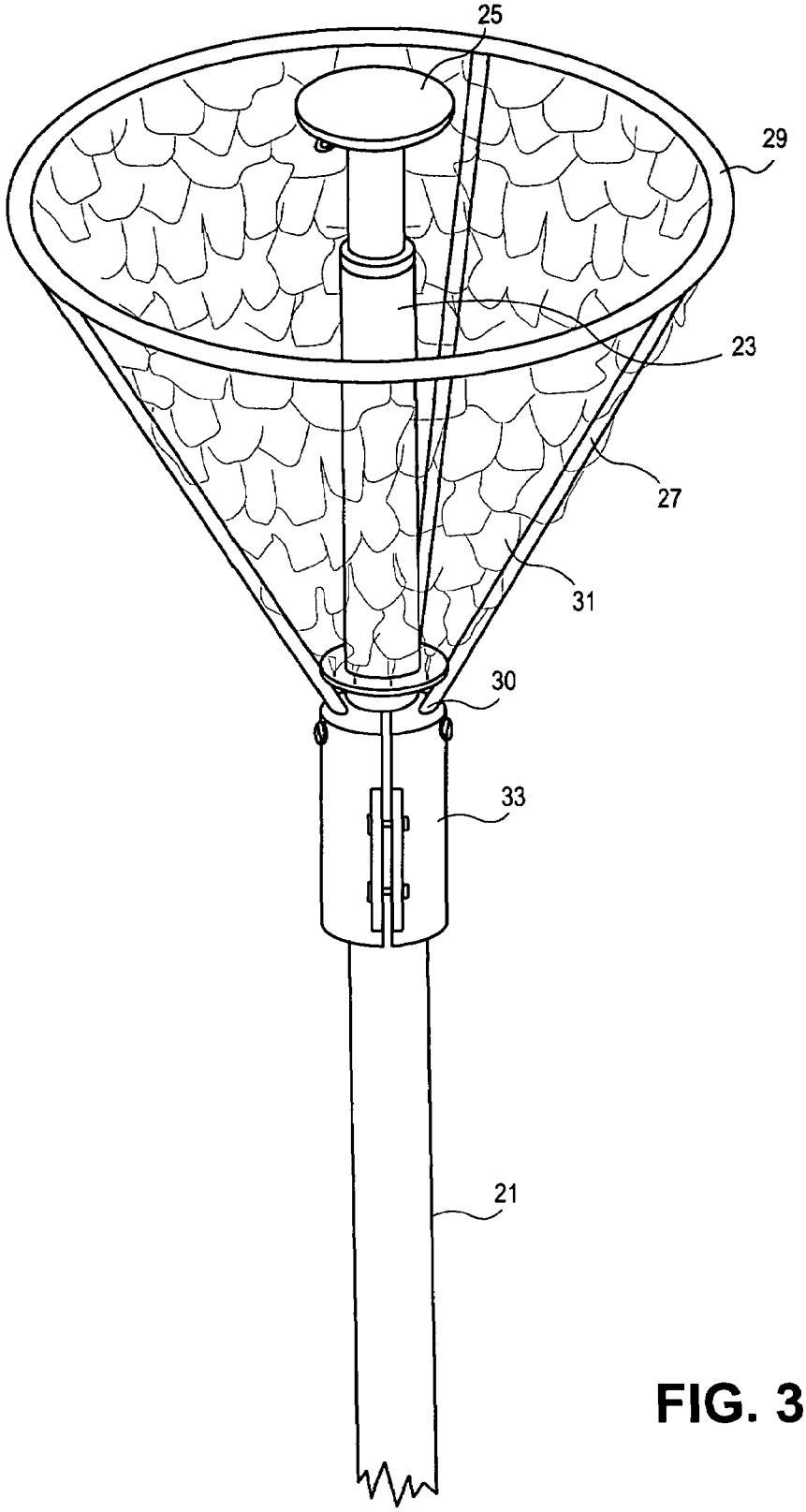
FIG. 3 is a side view of a catch according to an embodiment of the present invention.

FIG. 3 is another view of a catch designed according to an embodiment of the present invention. The work product end 23 of the pole 21 may be a continuation of the pole 21 or it may be multiple pieces of tubing. Often the work product end 23 of the pole 21 is designed so that it telescopes. In order to form a telescoping work product end 23, multiple pieces of tubing are fitted inside each other. The smallest tube is in the middle, with multiple larger tubes around the outside of the smallest tube. The tubes are hooked together so that when the smallest tube is extended from the work product end 23, it pulls the next smallest tube out after it and so on. The tubes must not, however, twist freely within each other. The work product end 23 must be able to transfer a twisting force to a light bulb attached to the attachment mechanism 25. This type of telescoping work product end 23 allows the user to make the work product end 23 of the pole 21 longer or shorter depending on their needs. It may be possible to lock the work product end 23 of the pole 21 so that it remains at a certain length.

Figure 6:
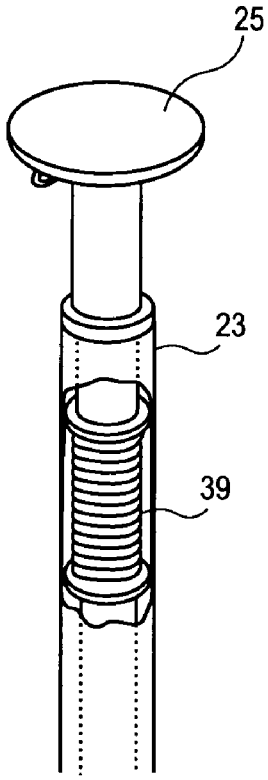
FIG. 6 is a side view of a work product end of a pole and attachment mechanism configured according to an embodiment of the present invention.

As illustrated in FIG. 6, it may also be possible to have the work product end 23 of the pole 21 be spring biased. A spring 39 would be placed in the telescoping work product end 23 of the pole or in other words, the spring 39 would be placed between two separate pieces of the work product end 23 of the pole 21. This allows the work product end 23 of the pole 21 to compress 2–4 inches depending on the compressive forces applied to it. The spring 39 allows the user to apply force to the light bulb changing device without damaging the light bulb or fixture. Also, by having the work product end 23 of the pole 21 spring braised, the spring 39 can compensate for movements up or down by the user which might otherwise damage the light bulb.

The work product end 23 may have many different cross-sections. It may have a circular cross-section, a square cross-section, a triangular cross-section and the like. The work product end 23 may also be formed from many different materials. The work product end 23 may be formed from metals such as copper, aluminum, steel, and the like. The work product end 23 may also be formed from plastics, or even from composites such as carbon fiber. The work product end 23 may be formed from the same material as the pole 21 or it may be formed from a different material. The work product end 23 of the pole 21 may be permanently attached to the rest of the pole 21 or it may be removably attached, allowing use of the work product end 23 without the rest of the pole 21.

An attachment mechanism 25 may be connected to the work product end 23 of the pole 21. This attachment mechanism 25 is used to grip the light bulb so that the light bulb may be removed from the socket. There are many different attachment mechanisms 25 that may be used to remove the light bulb from the socket. A few examples include, a suction cup that grips firmly to the light bulb allowing the user to twist the pole 21 and thereby twist the light bulb in the socket. Many examples of a suction cup attachment even include a release cord that allows the user to release the light bulb from the suction cup while the user is still at a distance. Other attachment mechanisms 25 involve the use of multiple suction cups. These suction cups are arranged so that they circle the edges of the light bulb. The suction cups each grip the light bulb. The bulb can then be removed from the socket, by turning the work product 23 of the pole 21 that the suction cups are attached to. The suction cups are then forced to rotate about the axis of the pole 21, loosening the bulb.

Clamps could also be used as an attachment mechanism 25. The clamps would close tightly around the light bulb, grasping it firmly. The pole 21 would then be turned, rotating the clamps, which also rotate the light bulbs removing them from their sockets. Vacuum seals have also been used as attachment mechanisms 25 in light bulb changing devices. The vacuum is placed firmly against the light bulb forming a seal. The vacuum is then rotated, thereby rotating the light bulb and removing it from the socket or tightening the bulb into the socket. There are many different attachment mechanisms 25 possible and virtually all of them may be used with the present invention.

Also attached to the work product end 23 of the pole 21 is a catcher 31. The catcher 31 surrounds the work product end 23 and the attachment mechanism 25 also. The catcher 31 may have a distal 29 and a proximal 30 end. The purpose of catcher 31 is to prevent the light bulb from falling if it comes free from the attachment mechanism 25. A falling light bulb can shatter and cause serious injury to the person changing the light bulb and to any bystanders. The issue of falling light bulbs has made the use of prior light bulb changing devices impractical.

The catcher 31 may be a net suspended on a frame 27 in the shape of a funnel. The net may be made from any number of materials, such as mesh, net, fabric, and the like. Preferably, the material should be transparent, translucent or see-through in order to allow the user to see the light bulb that they are working to replace or remove. The net may even be formed from plastic or some other solid material.

The frame 27 may be formed from metal, plastic or the like. In an example embodiment, the frame 27 would be deformable as would the net material in order to allow the user to compress the catcher 31 from an extended position to a retracted position as they engage or disengage the light bulb from a socket. The frame 27 may also be in any shape desired. The frame 27 may be cylindrical, pyramidal, funnel shaped and the like. The only requirements are that the frame 27 along with the net form a shape that will act to catch a falling light bulb, no matter what angle the pole 21 and attachment mechanism 25 are held at during normal operation. When the light bulb is being removed from the socket, the pole 21 will be lowered from a vertical position to a horizontal position. The catcher 31 should be able to catch the light bulb, even if the bulb is dropped when the pole 21 is in a horizontal position. In order to accomplish this, the catcher 31 should have walls that are substantially parallel to each other or the net material should be oversized so that the bulb is caught in the webbing below the distal end 29 of the catcher 31. This process is completed in the opposite order for replacing a light bulb, and again there is the risk that the bulb could be dropped as the pole 21 is in the horizontal position.

The length of the standard light bulb or spot light bulb is approximately four to seven inches. Accordingly, in an embodiment of the subject invention, the attachment mechanism 25 is recessed so that the distal end 29 of the catcher 31 extends between three to ten inches above the attachment mechanism 25. Thus the sides of a light bulb secured to the attachment mechanism 25 would also be surrounded by the catcher 31. By biasing the catcher 31 or by using a flexible frame 27, the bulb can be removed from the light bulb socket and as the pole 21 is withdrawn, the catcher 31 will re-extend so that the distal end moves back to an extended position from three to ten inches above the attachment mechanism 25. It also should be appreciated that the catcher 31 is loose on the frame 27 in one embodiment. Essentially, the catcher 31 has enough extra material to receive the bulb and prevent it from falling out of the catcher 31 if the pole 21 is in a position horizontal to the ground or even angled downward toward the ground. Thus, the amount of material used to form the catcher 31 is sufficient to billow and form a pocket between the pieces of the frame 27 to receive and sufficiently envelop a bulb received therein to prevent the bulb from falling out during normal usage. Furthermore, it should also be recognized that the distal end 29 forms a continuous perimeter about the attachment mechanism 25. This perimeter creates a lip around the entire distal end 29 of the catcher 31 to further retain the bulb within the catcher 31 when the pole 21 is in a non-perpendicular attitude relative to the ground as it is when being raised or lowered.

Figure 4:
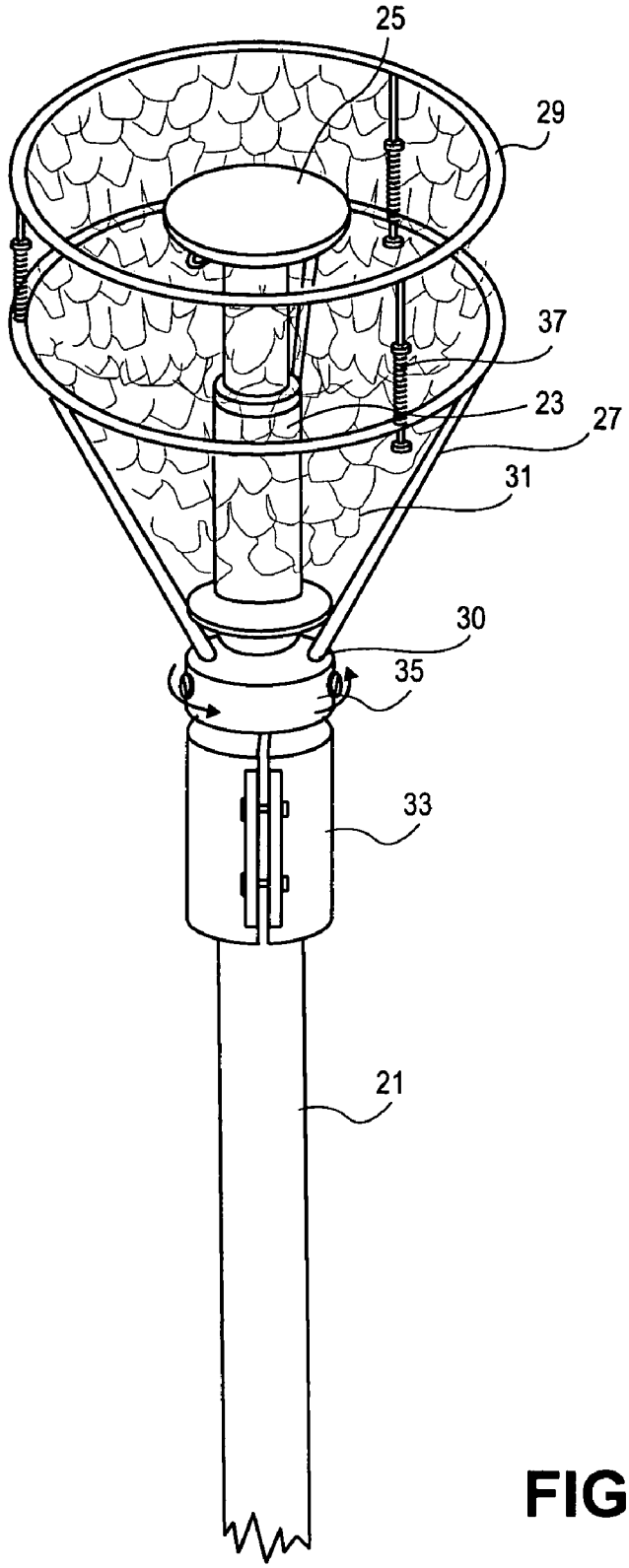
FIG. 4 is a side view of a catch according to an embodiment of the present invention.

As shown in FIG. 4, the distal end 29 of the catcher 31 frame 27 may be biased away from the user end 30 of the catcher 31 by a biasing device 37. This biasing device 37 would allow the distal end 29 of the catcher 31 frame 27 to shift towards the user end 30 of the catcher 31 when the catcher 31 is pressed firmly against something such as the ceiling, a light fixture or the like. This biasing allows the distal end 29 of the catcher 31 to compress 4–6 inches, depending on the pressure applied to the catcher 31. This, like the deformable frame 27, allows the user more maneuverability when they are manipulating a light bulb in a socket or fixture while still maintaining the catcher 31 around the bulb. The biasing may be caused by any number of springs or may be caused by other means beyond just a spring. The distal end 29 of the catcher 31 may be biased in anyway that would provide the desired results. The distal end 29 of the catcher 31 may even be biased by placing the biasing device 37 at the clamps 33 or proximal end 30 of the catcher 31. This configuration still provides that the distal end 29 of the catcher 31 is biased away from the user. In one embodiment the distal end 29 of the catcher 31 is circular and has a diameter of between 4–12 inches.

The proximal end 30 of the catcher 31 may be attached to a connector 33. This connector 33 may be designed to be bolted around the end of the pole 21 affixing the catcher 31 to the pole 21. The attachment of the catcher 31 to the pole 21 may be completed by many different means. The catcher 31 may be bolted directly to the pole 21. The catcher 31 may be designed and manufactured as an integral part of the pole 21. The catcher 31 may slide firmly onto the end of the pole 21 attaching through an interference fit, or the catcher 31 may be attached to the pole 21 through any number of connectors 33 or clamps. The catcher 31 may even be slideably connected to the pole 21.

Figure 5:
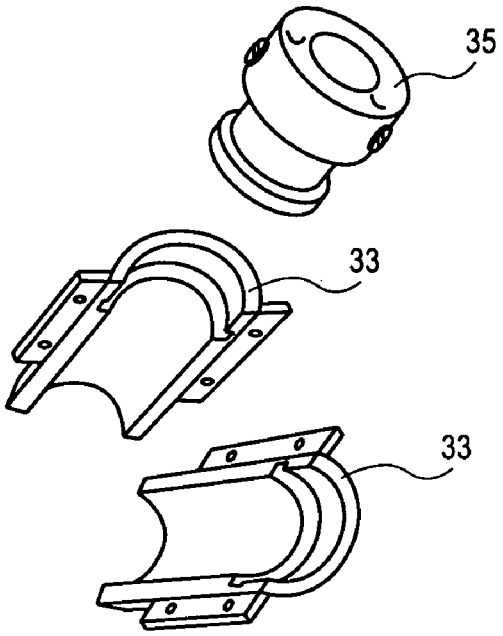
FIG. 5 is a view of connectors and a rotatable connector configured according to an embodiment of the present invention.

The catcher 31 may also be rotatably connected to the pole 21. As shown in FIG. 5, the rotatable connection 35 may contain bearings or may act as a bushing. This rotatable connection 35 allows the attachment mechanism 25 and work product end 23 of the pole 21 to rotate independently of the catcher 31. This means that the user will not have to struggle to rotate the entire unwieldy catcher 31 and work product end 23 of the pole 21 when trying to unscrew or screw in a light bulb. It also prevents the catcher 31 from scratching the ceiling, because the catcher 31 will be pressed firmly against the ceiling and then will not rotate. There are many different ways that the connector 33 or catcher 31 may be rotatably connected to the pole 21. This includes having a rotatable connection 35 which attaches to the catcher 31 and fits onto the pole. This rotatable connection 35 may act as a bushing or may contain bearings. The rotatable connection 35 is attached to the pole 21 by the connector 33. The rotatable connection 35 allows the pole 21 to rotate freely within the catcher 31.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

From the foregoing description and for the exemplary purposes of this disclosure, use of the catch depicted in the described embodiments of the invention provides many advantages over conventional catches, light bulb changing devices and methods. These advantages include more maneuverability and greater safety than conventional light bulb changing methods and devices.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A catch for use when installing and removing light bulbs comprising:

a pole having a work product end;

a light bulb attachment mechanism secured to the wok product end of the pole;

a catcher, having a proximal end adapted to be secured toward the work product end of the pole, and a distal end which extends beyond and surrounds the light bulb attachment mechanism secured to the work product end of the pole;

wherein the catcher is movable between an extended position wherein the light bulb attachment mechanism is located between the proximal and distal end of the catcher, and a retracted position wherein the light bulb attachment mechanism is moved toward the distal end of the catcher; and wherein the catcher is slideably secured to the pole.

2. The invention of claim 1 wherein the catcher has a rotatable connector for rotatably securing the catcher to the pole.

3. The invention of claim 1 wherein the catcher has a collapsible frame.

4. The invention of claim 1 wherein the distal end of the catcher extends between 3 to 10 inches beyond the light bulb attachment mechanism when the catcher is in the extended position.

5. The invention of claim 4 wherein the attachment mechanism is moveable between a forward position and a rearward position and is biased toward the forward position.

6. The invention of claim 4 wherein the attachment mechanism is a suction cup.

7. The invention of claim 1 wherein the light bulb attachment mechanism is moveable between a forward position and a rearward position.

8. The invention of claim 1 wherein the distal end is biased by a biasing device.

9. A device for installing and removing light bulbs comprising:

a pole having a work product end and a user end;

a light bulb attachment mechanism secured to the pole at the work product end;

a catcher having a proximal end secured to the pole toward the work product end, said catcher having a distal end which forms an opening whereby the attachment mechanism may be accessed, said distal end positioned such that the attachment mechanism lies between the proximal and distal ends of the catcher; and a rotatable connector for rotatably securing the catcher to the pole.

10. The invention of claim 9 wherein the distal end of the catch is moveable between an extended and retracted position.

11. The invention of claim 10 wherein the catch is extended in its quiescent state.

12. The invention of claim 10 wherein the catch is collapsible to move between the extended and retracted positions.

13. The invention of claim 10 wherein the catch is slideably secured to the pole for movement between said extended and retracted positions.

14. The invention of claim 9 wherein the distal end of the catch extends between 3 and 10 inches beyond the attachment mechanism.

15. The invention of claim 9 wherein the attachment mechanism is moveable between a forward and rearward position.

* * * * *